US005749574A

United States Patent [19]

Curtis

[11] Patent Number: 5,749,574

[45] Date of Patent: May 12, 1998

[54] COLLAPSIBLE SPORTS RACQUET

[76] Inventor: Stephen Curtis, 2128 Longview Dr., Tallahassee, Fla. 32303

[21] Appl. No.: 660,100

[22] Filed: Jun. 7, 1996

[51] Int. Cl.[6] ..... A63B 49/08

[52] U.S. Cl. ..... 273/73 J

[58] Field of Search ..... 273/73 R, 73 J, 273/73 G, 75, 67 R

[56] References Cited

U.S. PATENT DOCUMENTS

| | | | |
|---|---|---|---|
| 3,833,218 | 9/1974 | Frenkel et al. | 273/73 J |
| 3,968,965 | 7/1976 | Frenkel et al. | 273/73 J |
| 4,906,002 | 3/1990 | Goffney et al. | 273/73 J X |
| 4,915,382 | 4/1990 | Madsen | 273/73 J X |
| 5,129,656 | 7/1992 | Marte et al. | 273/73 J |

FOREIGN PATENT DOCUMENTS

| | | | |
|---|---|---|---|
| 2590802 | 6/1987 | France | 273/73 J |
| 3521621 | 1/1986 | Germany | 273/73 J |

*Primary Examiner*—William E. Stoll
*Attorney, Agent, or Firm*—Peter Loffler

[57] ABSTRACT

A collapsible sports racquet comprises a racquet having a handle with a male end and a pair of prongs extending upwardly therefrom. A racquet head has a neck and a female receptacle. Openings within the receptacle extend inwardly into a pair of channels. The prongs of the handle are received within the channels. Resilient detents on the handle are received within openings located on the receptacle and provide releasable securement of the handle to the head.

4 Claims, 3 Drawing Sheets

COLLAPSIBLE SPORTS RACQUET

BACKGROUND OF THE INVENTION

1. Field of the Invention

The present invention relates to a collapsible sports racquet.

2. Background of the Prior Art

The benefits of using a collapsible sports racquet are well known. If a racquet string breaks, the racquet head can be quickly replaced allowing the player to maintain a favorite handle. Conversely, a damaged or sweaty handle will allow a changeover while maintaining the current desired racquet head. Collapsible sports racquets are known in the art. Examples of such racquets can be found in U.S. Pat. No. 4,052,060 issued to Balkcom, U.S. Pat. No. 4,007,929 issued to Figa, and U.S. Pat. No. 5,108,114 issued to Marx, among others.

These and other examples of collapsible sports racquets suffer from one of three shortcomings. The collapsible racquet is unduly complex making its use difficult and undesirable, especially in a competition setting. Some collapsible racquets greatly alter the outer contour of the racquet, particularly near the handle. A player will not use a racquet that requires avoidance of certain hand grips or racquet heads. The current devices also alter the balanced weight of the racquet.

The most prevalent problem found with most collapsible sports racquets is that they fail to eliminate longitudinal and torsional movement of the head relative to the handle. Such movement, even if slight, will adversely affect the harmonic recoil of the racquet during a ball response, resulting in an unintended shot.

Therefore, there is a need in the art for a collapsible sports racquet that overcomes the shortcomings associated with current collapsible sports racquet technology. Such a racquet must be of relatively simple construction that permits quick and easy collapse and reasssembly of the device. Such a device must not unduly change the outer contours of the racquet. The device must eliminate torsional and longitudinal movement of the head relative to the handle.

SUMMARY OF THE INVENTION

The collapsible sports racquet of the present invention addresses the above-stated needs in the art. The present invention provides a sports racquet wherein the head separates from the handle. The handle is comprised of a hand grip having a male end thereon. Extending upwardly from the male end are a pair of resilient prongs.

The head of the collapsible sports racquet of the present invention is comprised of a racquet head having a neck. The neck has a receptacle having a pair of openings with a pair of channels extending therefrom terminating prior to the head.

The male end of the handle is inserted into the receptacle of the head such that the prongs of the handle are received through the openings and thereafter within the channels of the head. Detents within the handle are received and secured within openings located on the receptacle providing a releasably secure fit of the handle to the head.

The collapsible sports racquet of the present invention provides a device wherein the head is readily and quickly releasable from the handle. The prongs of the handle are received within the channels of the head and provide a fit that prevents torsional and longitudinal movement of the handle with respect to the head. Such a device is readily collapsible allowing for quick change of either head or handle and providing a compact unit for storage and transport. The present invention does not alter the outer contour of the racquet nor change the racquet's balanced weight.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
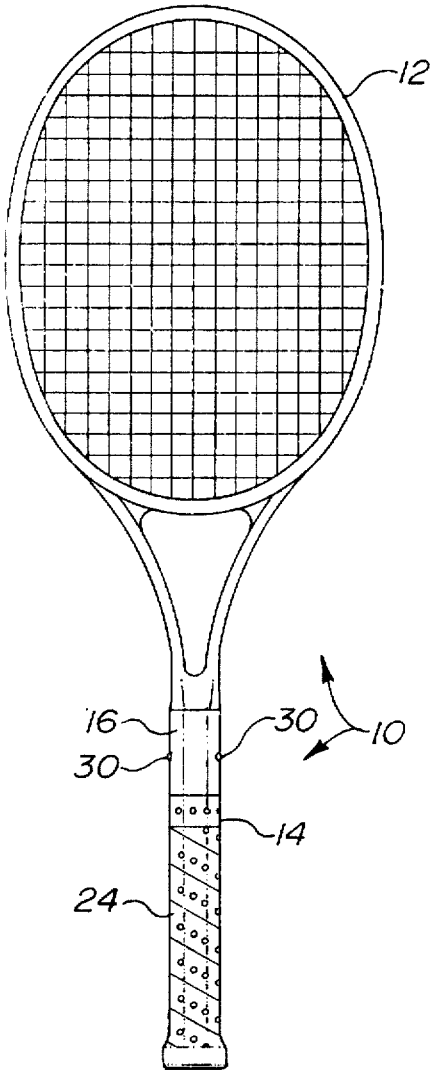
FIG. 1 is an elevation view of the collapsible sports racquet of the present invention.

Referring now to the drawings, it is seen that the collapsible sports racquet of the present invention, such as a tennis racquet, a racquetball racquet, or a badminton racquet, is generally denoted by reference numeral 10. The device 10 comprises a head 12 and a detachable handle 14. The head 12 can be either single neck or dual neck. As seen, the end 16 of the head 12 has a receptacle 18 defining a handle receiving opening. A pair of opposing openings 20 are located on the wall of the receptacle 18. A pair of channels 22 extend from the base of the receptacle 18 into the neck, contoured therewith, and terminate prior to the head 12.

Figure 2:
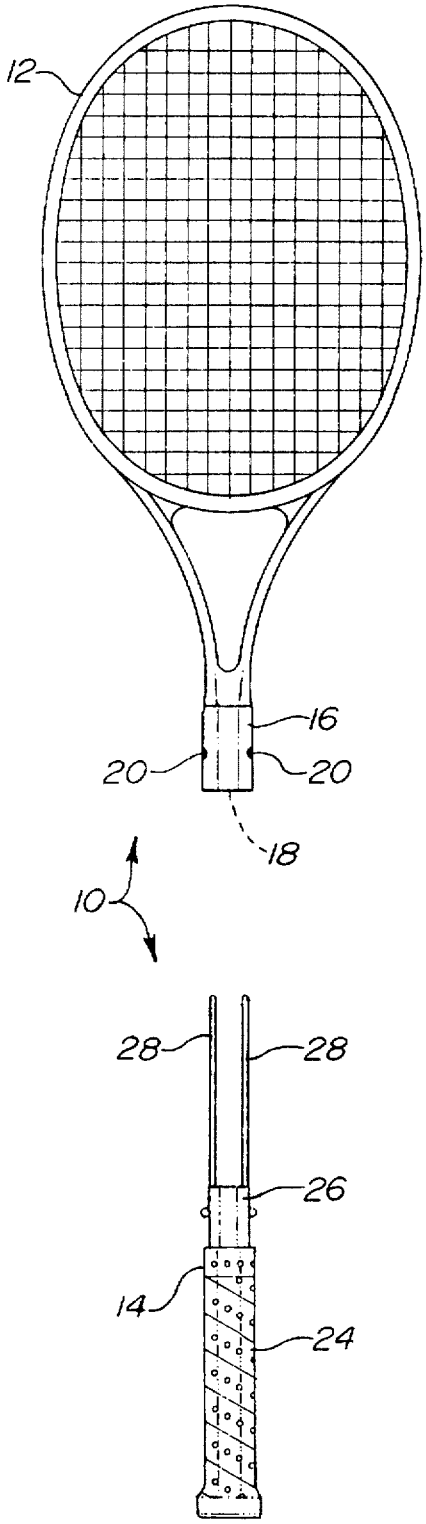
FIG. 2 is an exploded view of the collapsible sports racquet.
Figure 3:
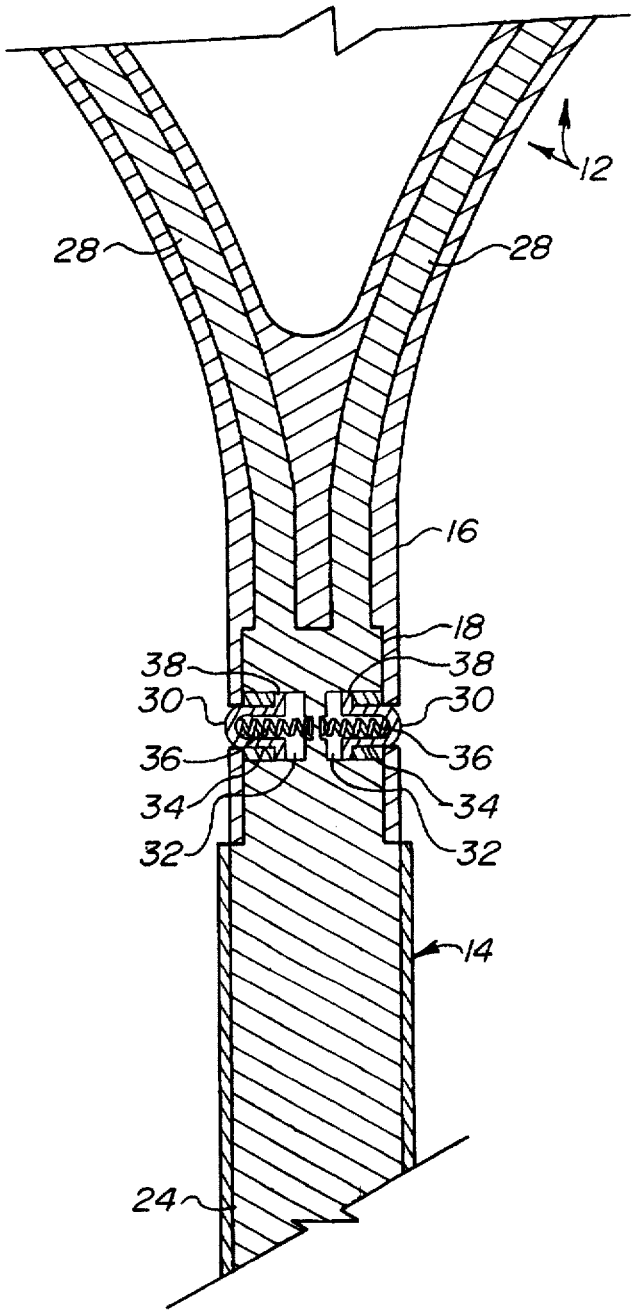
FIG. 3 is an exploded and sectioned view of the collapsible sports racquet.
Figure 4:
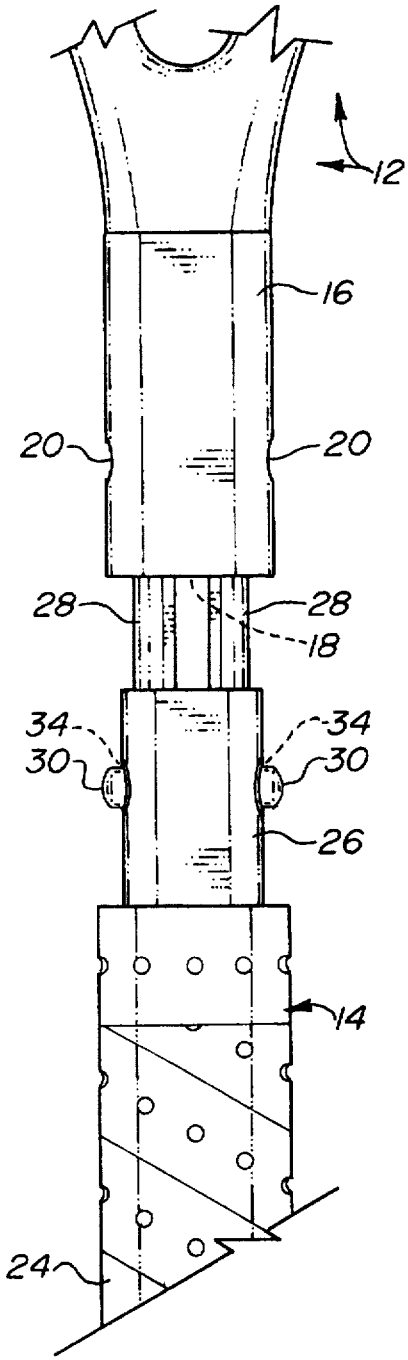
FIG. 4 is a section view of the collapsible sports racquet.
Figure 5:
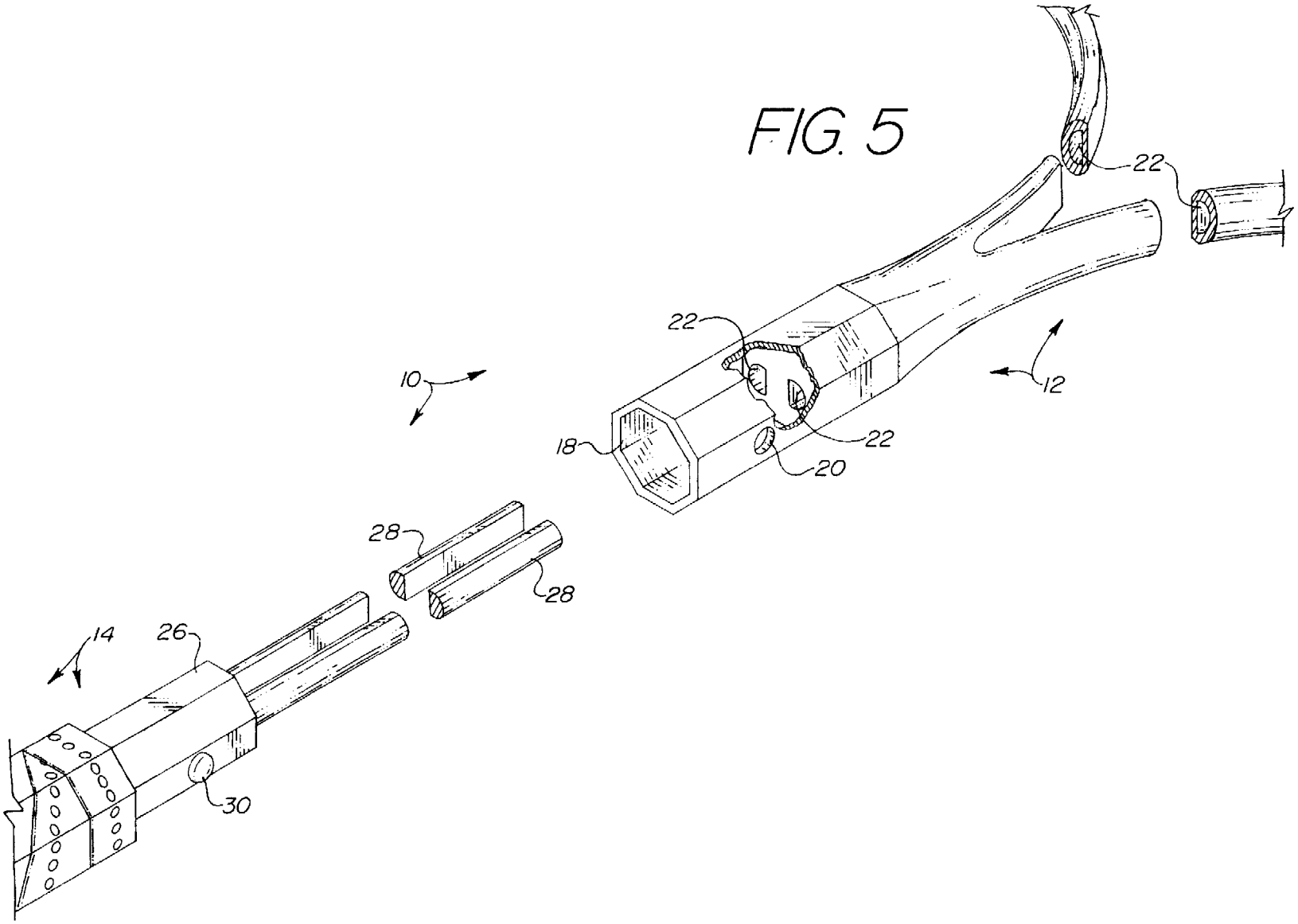
FIG. 5 is an elevation view of the head being connected to the handle.

As seen in FIG. 2, the handle 14 is comprised of a hand grip 24 and an end 26. The shape of the end 26 is in corresponding shape to the shape of the receptacle 18. Extending upwardly from the end 26 are a pair of generally resilient prongs 28. The cross-sectional shape of the prongs 28 is in corresponding cross-sectional shape of the channels 22. As seen in FIG. 4, a pair of detents, such as the illustrated buttons 30, are disposed within a cavity 32 of the end 26 and opposite one another. The buttons 30, protrude through the walls of the end through openings 34. One or two compression springs 36 bias the buttons within the openings 34 while button flanges 38 prevent expulsion of the buttons 30 from the openings 34.

In order to secure the handle 14 to the head 12 the prongs 28 are inserted into the receptacle 18 and thereafter, each individual prong 28 is received within an individual channel 22 and resiliently slid into place. The resiliency of the prongs 28 permits the prongs to follow the curved contour of the channels 22. Insertion is continued until the end 26 of the handle 14 is received within the receptacle 18 and the buttons 30 register with and pop through the openings 20. As the prongs 28 are received within the curved channels 22, the prongs 28 flex outwardly creating a spring-like tension within the channels 22 and thereby helping hold the head 12 within the handle 14. The handle 14 is now locked to the head 12. The buttons 30 hold the handle 14 firmly in place and prevent the handle end from sliding back out from the receptacle 18. The prongs 28 received within the channels 22 further assist in holding the head 12 to the handle 14 and also prevent torsional twisting of the head 12 relative to the handle 14. Ideally, the cross-sectional shape of the prongs 28 and the corresponding cross-sectional shape of the channels 22 will be non-circular so that the prongs 28 can engage the channels 22 in order to assist in preventing the torsional twisting. Furthermore, the cross-sectional shape of the handle end 26 and the corresponding cross-sectional shape of the receptacle 18 are non-circular and preferable multi-faceted so that the panels of the end 26 can engage the walls of the receptacle 18 to further assist in preventing torsional twisting.

In order to detach the head 12 from the handle 14, the buttons 30 are squeezed by the user's thumb and index finger and the handle 14 is withdrawn.

While the invention has been particularly shown and described with reference to an embodiment thereof, it will be appreciated by those skilled in the art that various changes in form and detail may be made without departing from the spirit and scope of the invention.

I claim:

1. A collapsible sports racquet comprising:

a handle having a male end with a pair of prongs extending therefrom;

a racquet head having a receptacle, in corresponding shape to the shape of the male end, with a pair of opposing openings;

a pair of channel openings locatable within the receptacle;

a pair of channels extending inwardly from the pair of channel openings for receiving the pair of prongs; and a pair of detents, located on the male end of the handle receivable within the pair of openings.

2. The device as in claim 1 wherein the pair of channel openings and the pair of prongs each have non-circular cross-sectional shape.

3. The device as in claim 1 wherein the male end and the receptacle each have non-circular cross-sectional shape.

4. The device as in claim 1 wherein the pair of detents are springedly biased.

* * * * *